United States Patent [19]

Almeida

[11] Patent Number: 4,537,211

[45] Date of Patent: Aug. 27, 1985

[54] APPARATUS FOR IMPROVING OIL STORAGE TANKS

[76] Inventor: Robert Almeida, 29 Overhill Rd., Scarsdale, N.Y. 10583

[21] Appl. No.: 495,247

[22] Filed: May 17, 1983

[51] Int. Cl.[3] ..... F17D 1/00

[52] U.S. Cl. ..... 137/1; 137/172; 137/574; 210/534

[58] Field of Search ..... 137/571, 574, 576, 1, 137/546, 172, 264, 2, 559; 210/172, 533, 534; 138/DIG. 11

[56] References Cited

U.S. PATENT DOCUMENTS

| | | | |
|---|---|---|---|
| 1,113,683 | 10/1914 | Pfahler | 210/172 |
| 1,135,900 | 4/1915 | Hughson | 210/172 |
| 1,530,077 | 3/1925 | Haynes | 210/533 |
| 1,548,400 | 8/1925 | Walker | 210/172 |
| 1,714,338 | 5/1929 | Yelmgren | 210/534 |
| 2,422,869 | 6/1947 | Wiggins | 137/571 |
| 3,964,873 | 6/1976 | Aramaki et al. | 138/DIG. 11 |
| 4,107,052 | 8/1978 | Yoshino et al. | 137/172 |
| 4,170,877 | 10/1979 | Pickering | 137/574 |

FOREIGN PATENT DOCUMENTS

| | | | |
|---|---|---|---|
| 805512 | 5/1951 | Fed. Rep. of Germany | 138/DIG. 11 |

*Primary Examiner*—A. Michael Chambers
*Attorney, Agent, or Firm*—Jay H. Maioli

[57] ABSTRACT

A positive-displacement mass is introduced at the lowermost portion of an oil storage tank in order to reduce the amount of undrawable oil that remains at all times below the top edge of the suction line. It is necessary that the suction line not be occluded or interfered with and that the settled water at the bottom of the tank be permitted to be drawn off. In one aspect a tray is fitted into the bottom area of the tank and filled with water, or with inert solids, to displace the oil normally held as inventory at such location. In another aspect, a coffer dam is arranged around the suction line to permit the accumulation of water in the tank bottom, and in yet another aspect the shape and placement of the suction line nozzles are altered to improve storage efficiency.

16 Claims, 11 Drawing Figures

APPARATUS FOR IMPROVING OIL STORAGE TANKS

BACKGROUND OF THE INVENTION

1. Field of the Invention

The present invention relates generally to reducing the amount of fluid normally maintained in the bottom of a tank and, specifically, reducing the amount of undrawable oil located below the top edge of the suction line in an oil storage tank.

2. Description of the Prior Art

In the modern world the storage of petroleum, both crude and refined, is an important part of efficient energy management. The typical oil storage tank, whether fixed or floating roof, has an inlet pipe and intake valve located in the side of the tank near the bottom and a corresponding suction line and delivery valve also located in the side near the bottom of the tank. The tank bottom is generally sloped downwardly toward the middle to collect water and other sediment, which settles out during storage. A valved water draw off line is connected to the lowermost point in the tank so that water and sediment that has collected can be periodically removed. The suction line or outlet is round and may be typically one to three feet in diameter. It is located with its bottom edge as close to the bottom of the tank as is consistent with ensuring that no water or sediment enters the suction line, usually about one foot is sufficient. When drawing off the stored oil, the oil level can not be permitted to fall below the top edge of the suction line, otherwise the pump will suck air and other vapors in the tank and lose its prime, thereby becoming vapor locked, and be ineffective. Therefore, there exists at the bottom of all oil storage tanks a layer of oil, of a depth at least equal to the diameter of the suction line, with reasonable margins above and below. This layer of oil is typically up to four feet deep and is not available for use during the period the tank is in service. This is the deadstock or undrawable bottoms. Only at the time that the tank is totally drained through the water drawoff line can this oil be recovered and made available for use. Such draining takes place only about once every five years when the tank is emptied and cleaned. As soon as the tank goes back into service, the deadstock is there again. Given the large size of most oil storage tanks and an approximate price of $30 a barrel, it can be easily seen that vast amounts of oil worth millions of dollars are presently represented by these "undrawable bottoms" or "heels" in the bottoms of the existing oil storage tanks. The present requirement to maintain a relatively large inventory due to uncertainties of availability and price is in no way assisted by this deadstock, since it is undrawable and, therefore, not available to meet product demands.

OBJECTS AND SUMMARY OF THE INVENTION

Accordingly, it is an object of the present invention to provide method and apparatus for use with bulk oil storage tanks that reduce the volumes held as undrawable bottoms.

It is another object of the present invention to reduce the volumes of oil held as undrawable bottoms in bulk storage by adding a volume displacement device at the bottom of the tank, without impeding required tank operations.

It is a further object of the present invention to reduce the volume of oil held as undrawable bottoms in bulk storage tanks by specially sized or specially oriented suction lines.

It is also an object of the present invention to provide apparatus to reduce the amount of oil held as undrawable bottoms that may be incorporated in newly fabricated bulk storage tanks or that may be retrofitted to existing tanks, either when they are removed periodically from service for maintenance and cleaning or while they are still in service.

In one aspect of the present invention, a positive displacement device is arranged in the bottom of a bulk storage tank to displace the volume of oil normally held below the top edge of the suction line and the bottom of the tank that was previously undrawable. The inventive apparatus includes structural elements to permit water and sediment to be drawn off from the bottom of the tank in the conventional fashion and also provides structural elements to prevent occluding the suction line during delivery of the oil in storage. The displacement device can comprise a closed hollow disc structure to displace the oil or a tray-like structure to hold water, clay bricks, or plastic spheres or containers filled with water or sand or the like. In all cases the oil intake line, the suction line and the water draw off line must remain unobstructed.

In another aspect of the invention, coffer dams are arranged around the intake and suction lines; the volume defined by the coffer dams and the bottom of the tank is then filled with water or other inert material. The water level is monitored and adjusted periodically to maintain it below the height of the coffer dam. The stored oil occupies the volume above the controlled level of the water and spills over the coffer dam to keep the suction well around the suction line full of oil at all times.

The invention also provides a means of utilizing previously undrawable bottoms by altering the size and arrangement of the suction line or delivery line, particularly when a tank cannot be removed from service for internal modifications. The quantity of deadstock in the undrawable bottom is a function of the location of the top of the suction line and, therefore, the vertical dimensions of the suction line. The present invention provides method and apparatus to lower this location in relation to the bottom of the tank by providing a flattened delivery tube that has approximately the same cross sectional area as the original round delivery line but because of the flattened profile, the lowered top reduces the thickness of the deadstock layer. The invention also contemplates use of a plurality of smaller diameter delivery lines so arranged that the lowest points on these lines are at the same level as the low point of the original delivery tube and are connected through a manifold or header to the suction pump.

The manner in which these and other objects are accomplished by the present invention will be explained in relation to the following detailed description and drawings, wherein like reference numerals denote like parts.

DESCRIPTION OF PREFERRED EMBODIMENTS

Figure 1:
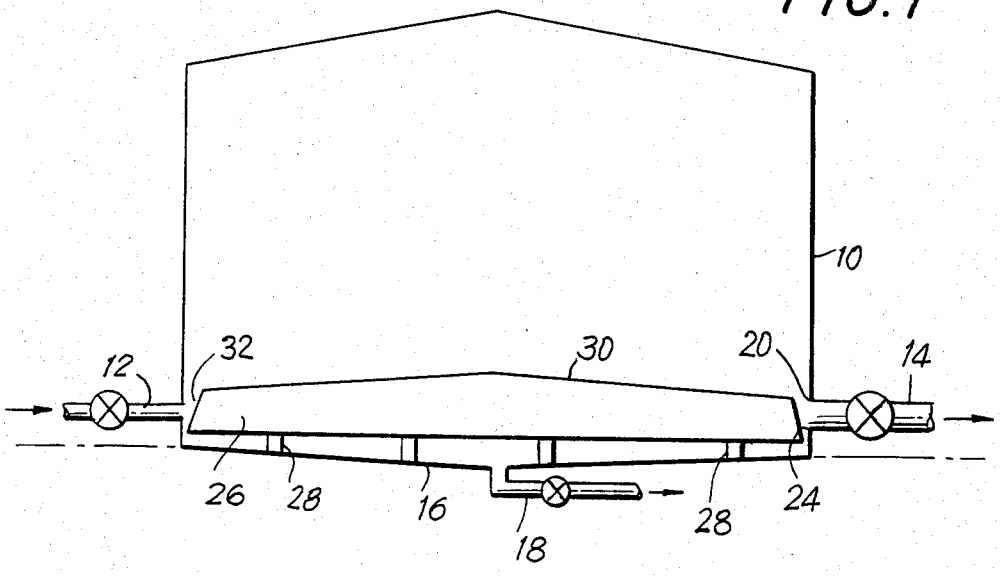
FIG. 1 is a schematic representation in cross section of a storage tank according to one embodiment of the present invention.

Referring now to FIG. 1, an oil storage tank 10 is shown having an embodiment of the present invention installed therein. Bulk storage tank 10 is of the conventional kind having a valved intake line 12 and a valved delivery or suction line 14. It is known practice to slope the bottom of the tank toward the center, as shown at 16, and to provide a valved outlet line 18 connected to the lowest point in the tank bottom. The sloped bottom 16 serves to collect water and sediment in the tank, so that it may be drained off through line 18.

The amount of oil in tank 20 according to known procedures that constitutes the undrawable bottom is defined by the top edge 20 of outlet line 14 and the bottom edge 24 of outlet line 14 and reasonable operating margins above and below these edges. It is not an acceptable solution to simply lower the location of delivery line 14, since the volume below the lower edge 24 of delivery line 14 must be maintained to accumulate water and sediment and the like between the times that such is drawn off by line 18.

This volume heretofore occupied by deadstock is filled according to the present invention by a closed metal disc 26 that is hollow and fluid tight. The hollow disc 26 rests on the tank bottom 16 by means of several legs or supports, shown typically at 28. The top surface 30 of the hollow metal disc 26 is sloped gently upwardly so that water and sediment in the oil will not reside upon the hollow metal positive displacement disc 26.

Disc 26 has the same diameter as the tank, except that an adequate clearance space is provided in front of delivery tube 14, thus providing a suction well inside the tank around delivery tube 14. It is necessary that these tubes not be obstructed and to further assist smooth fluid flow to the suction line, the side walls 32 of disc 26 are sloped generally inwardly. A similar intake well is provided around the intake tube 12, or the intake tube 12 can be relocated upwardly.

Figure 2:
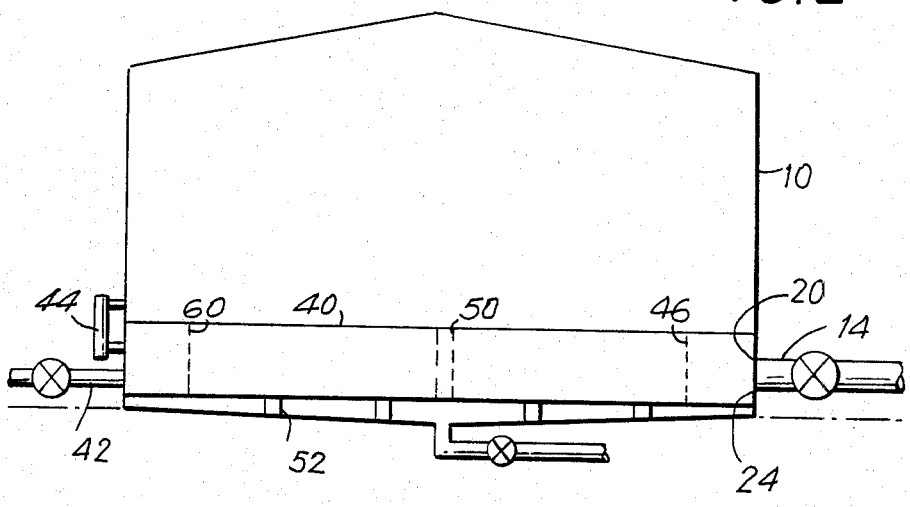
FIG. 2 is a schematic representation in cross section of a storage tank according to another embodiment of the present invention.

FIG. 2 shows another embodiment of the present invention in which in place of the closed hollow disc of FIG. 1, structure 40 or tray filled with water or other solid inert material is provided. This fluid filled tray 40 again serves to displace the oil that would normally be deadstock in the volume of tank 10 defined by the top edge 20 of delivery tube 14 and the bottom edge 24 of the delivery tube. The interior of structure 40 is in communication with a valved fill/drain pipe 42 so that structure 40 can be filled with water to occupy the volume previously occupied by deadstock. A sight glass or gauge glass 44 may be provided so that the level of fluid in structure 40 can be monitored. Once again it is necessary to maintain the delivery tube 14 free from obstructions, and the overflow weir 46 of structure 40 is slanted inwardly to provide adequate clearance for fluid flow. This embodiment may similarly have a provision to keep the area around oil intake line 12 free of obstruction or the line may be relocated above the level of water in the tray. A central drain 50 may be provided to permit excess water flow to the bottom of the tank to be ultimately drawn off. The level of water in the tray is determined by the height of the central drain 50 and may be set slightly lower than the overflow weir 46, so that within structure 40, there always remains a thin layer of oil on top of the water level with additional volumes of oil spilling over the overflow weir 46 to fill the suction well around delivery outlet 14. Structure 40 can be supported by legs or supports, shown typically at 52.

Figure 3:
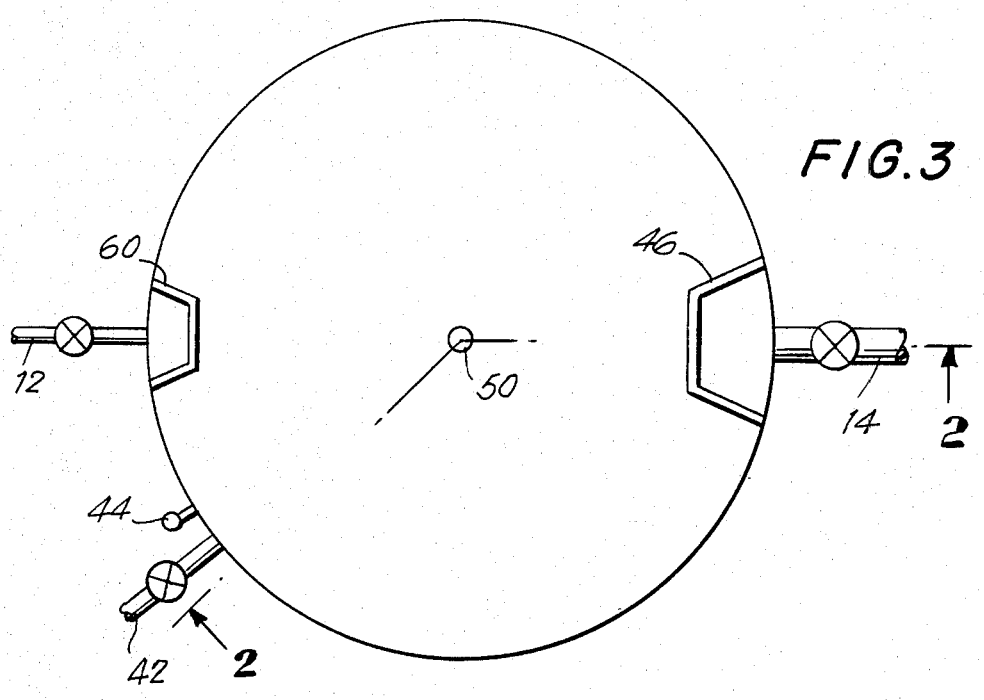
FIG. 3 is a schematic representation of a top plan view of the tank of FIG. 2.

FIG. 3 is a top plan view of the storage tank of FIG. 2. and shows the section lines 2—2 along which the cross-sectioned view of FIG. 2 is taken. The overflow weir 46 has a corresponding inlet cutout 60 also formed in tray 40 in order to maintain free access for the liquid relative to oil inlet tube 12. Specifically, cutout 60 is formed in tray 40 at the location of inlet line 12, and cutout 46 is formed in tray 40 at the location of delivery line 14. Each of these cutouts 46, 60 is formed as a weir, with the edges thereof being slightly higher than the top of central overflow drain tube 50, in this fashion a thin layer of oil is formed on top of the water held in tray 40 and the suction well around delivery tube 14 remains free of water and filled with oil. The tray 40 is attached at its periphery to the inside of tank 10, as seen in FIG. 3. The need for providing cutout 60 can be avoided by repositioning the oil inlet tube 12 above the level of water in tray 40.

Figure 4:
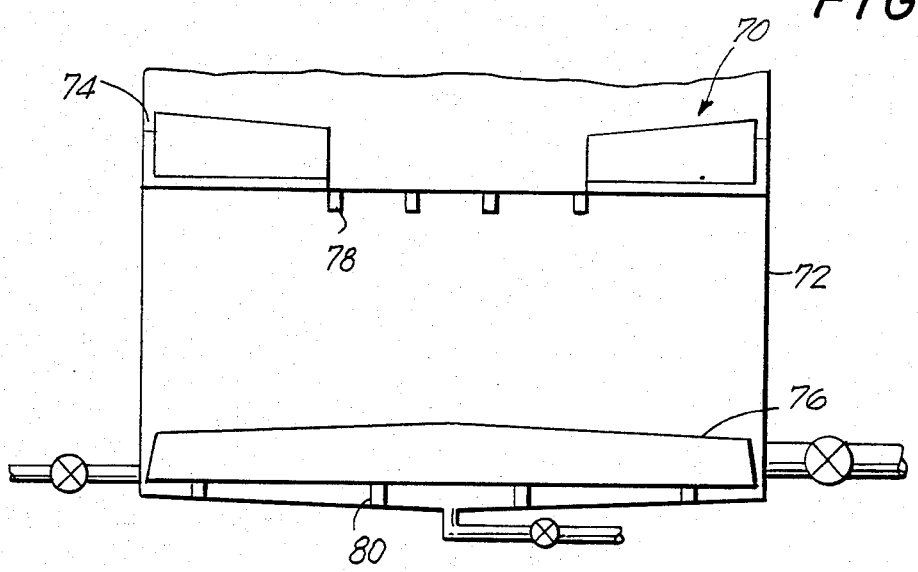
FIG. 4 is a schematic representation in cross section of a floating roof storage tank according to an embodiment of the invention.

All of the above described bulk storage tanks have been of the fixed roof kind, however, there is at least one other kind of bulk storage tank adaptable for use according to the present invention, e.g., the floating roof bulk storage tank. In this kind of tank the position of the top or roof of the tank is adjusted vertically depending upon the volume of fluid stored therein. One such floating roof tank according to the present invention is shown in FIG. 4, and the floating roof 70 is movable in the vertical direction in relation to the tank 72 and is in sealing relation therewith in the conventional fashion, as represented typically at 74. A positive displacement element 76 is arranged in the bottom of the tank at the location normally occupied by the deadstock and, in the example in FIG. 4, the positive displacement element is the closed hollow disc 26 of FIG. 1. Any of the other embodiments of the positive displacement element described herein could also be employed. Because the floating roof 70 can move downwardly to such an extent as to interfere with the closed hollow disc, standoffs or supports 78 are affixed to the lower inner surface of floating roof 70. By means of these standoffs, when the floating roof 70 is at its lowermost point of travel, it will be limited and supported by the positive displacement element 76, that has its own supports or legs, shown typically at 80.

Figure 5:
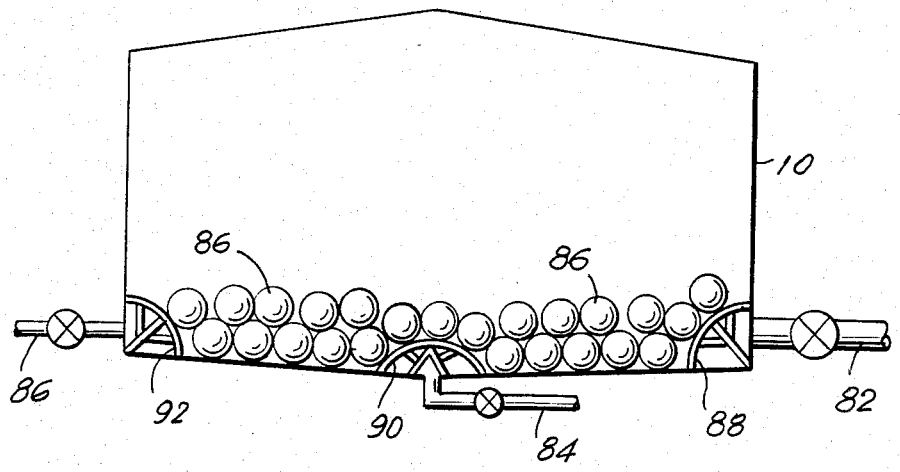
FIG. 5 is a schematic representation in cross section of a storage tank according to another embodiment of the invention.

All of the heretofore described embodiments to lessen the volume of deadstock in bulk storage tanks require taking the tank off line, cleaning it, entering it with personnel and constructing the modification. In FIG. 5 an embodiment of the present invention is shown that does not require taking the tank off line and that can be modified to lessen the amount of deadstock by inserting elements through a hatch (not shown) in the top of the tank. More specifically, the amount of deadstock in tank 10 is reduced as much as possible by filling the space normally occupied by the deadstock with positive displacement elements, these elements being inserted into the oil contained in tank 10 and allowed to sink to the bottom of the tank. In this embodiment the deadstock volume is occupied by plastic or neoprene rubber spheres filled with water, shown typically at 86. The water-filled plastic sphere 86 is only one embodiment, and there are many equivalents that could be employed following the present invention. As in the previously described embodiments, it is necessary to prevent the outlet or delivery tube 82 from being occluded, as well as keeping the water drain line 84 and oil intake line 86 free. To accomplish this the invention provides shields or guards that may be either inserted through the hatch in tank 10 and appropriately arranged or the shields may be inserted through the tube or line that they are protecting, in which case, the shield would be of a partially collapsible nature. Specifically, shield 88 is arranged in front of delivery line 82 in order to prevent the positive displacement devices 86 from obstructing the line. Similarly, shield or guard 90 is arranged in front of water drawoff line 84 and shield 92 is arranged in front of intake line 86. These shields, 88, 90, and 92 are constructed as a frame work that permit oil and water to flow through, yet will prevent the positive displacement means from obstructing fluid flow. Note that the insertion of the shield into the tank through the respective fluid line is made possible because these lines are substantial in size. Although the figures herein are not to scale, the delivery line 82 is typically one to three feet in diameter.

Figure 6:
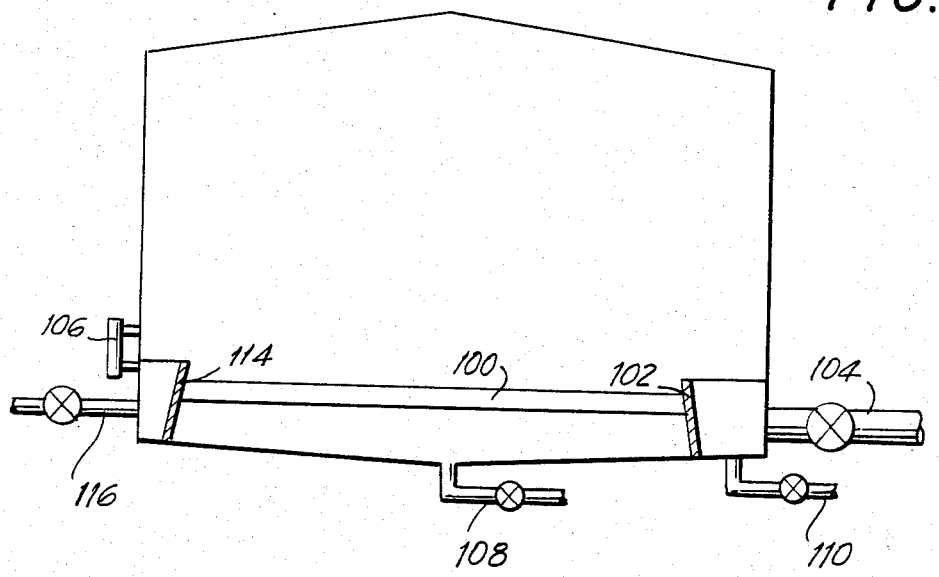
FIG. 6 is a schematic representation in cross section of a storage tank employing the coffer dam embodiment of the present invention.
Figure 7:
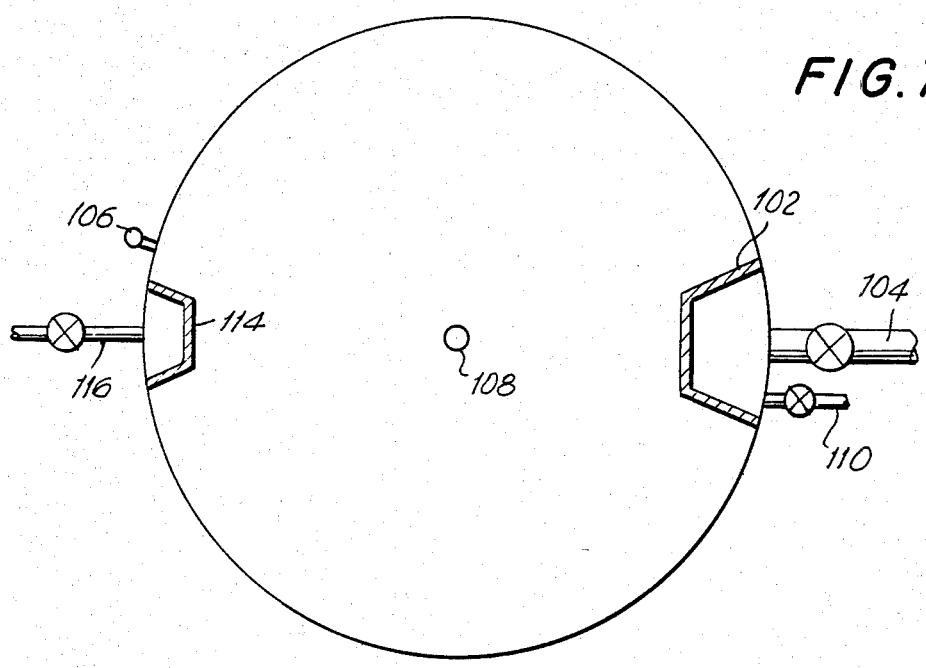
FIG. 7 is a top plan view in cross section of the embodiment of FIG. 6.

The above-described embodiments of the invention have all relied upon the insertion or addition of positive displacement structures into the tank to replace the deadstock volume, however, in the embodiment of FIGS. 6 and 7, water is caused to reside in the tank at the location previously occupied by the deadstock. Although there is normally a certain amount of water residing in the bottom of a bulk storage tank, the invention teaches to increase the amount of water substantially with the water 100 contained behind a coffer dam 102 so arranged at the inlet of delivery line 104 as to keep the delivery line free of water and filled with oil. The level of water is monitored by a sight glass 106 and controlled to be below the height of the coffer dam 102 by periodic drainage through the existing water draw off line 108. Since over a period of time, small amounts of entrained water may settle out in the suction well around delivery line 104, the suction well defined by coffer dam 102 is also provided with a small water draw off line 110, in addition to the main water draw off line 108. A similar coffer dam 114 relative to the intake line 116 is provided, however, this coffer dam 114 can be eliminated by repositioning the oil inlet line 116 to a higher level. The level of water 100 can be adjusted by periodically drawing off water through drawoff line 108.

The above-described embodiments of the invention all serve to reduce undrawable bottoms by adding elements to the inside of a tank, however, in another embodiment of the invention, the amount of deadstock in a tank is reduced by means attached only to the outside of a tank. The present invention contemplates replacing the conventional round suction nozzle used in bulk storage tanks with an elliptical or rectangular nozzle or with several smaller nozzles with a view to reducing the thickness of the layer of oil required to keep the suction line primed and full of oil. The dimensional relationships of the new nozzles are represented in 8A, 8B, 8C, and 9.

As set forth above, a primary determinant of the amount of undrawable bottoms in a bulk storage tank is the diameter of the suction nozzle. The lowest level to which the oil may be drawn is the top edge of the suction nozzle, since going below this line will permit the pump to suck air or other vapors and to become vapor locked. Because many delivery lines or suction lines are frequently as large as one to three feet in diameter, it is evident that a large layer of oil must reside in the tank as deadstock.

Figure 8A:
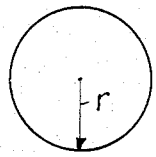
FIGS. 8A, 8B, and 8C are schematic representations of suction or delivery lines for use in a storage tank according to the present invention.
Figure 8B:
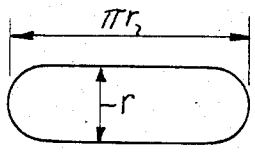
Figure 8C:
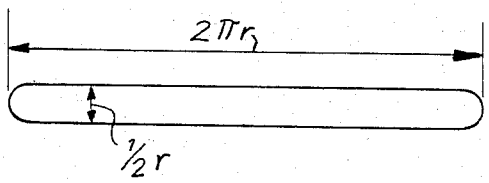

The invention reduces this volume of deadstock by lowering the topmost level of the suction nozzle. In one aspect of the invention, this can be done by providing an elliptical or rectangular suction nozzle of a size to provide the same cross-sectional area as the standard round suction nozzle. This relationship is easily demonstrated by the dimensions of the various sized nozzles. For instance, FIG. 8A represents a standard round nozzle of radius r, while FIG. **8*b* represents a flattened nozzle having the same cross-sectional area as the nozzle of FIG. 8C. FIG. 8C is a still flatter suction nozzle but still having a cross-sectional area equal to the other nozzles. Note that in both nozzles of FIGS. 8B and 8C the uppermost edge of the nozzle is lower than or below the upper edge of the standard round suction nozzle of FIG. 8A**, thus permitting a reduction in the volume of oil held as deadstock. As another alternative, the conventional round suction line can be replaced by four smaller suction nozzles having a diameter r that is equal to the radius r of the original suction nozzle. The bottom edge of these four replacement nozzles would be at a line defined by the botton edge of the original round suction nozzle, thus reducing by 50% the thickness of the layer required to fill the suction nozzle and thereby the volume of oil held as deadstock. Other variations in sizes are of course possible, with multiple nozzles of the smallest possible size providing the maximum reduction in deadstock.

Figure 9:
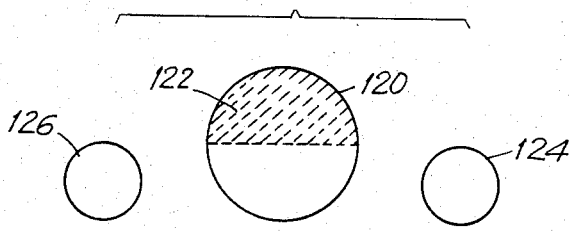
FIG. 9 is another schematic representation of suction lines for use according to the present invention.

In still another emodiment, the existing round suction nozzle 120 of FIG. 9 is retained, but the upper half of the nozzle is blocked off, as represented by the shaded area 122. This has the effect of permitting the oil in the tank to be at a lower level before there is a danager of vapor-locking the pump. The area lost by block 122 is made up by two additional nozzles 124 and 125, again located with their bottom edge aligned with the bottom edge of main suction nozzle 120.

The suction nozzles of FIG. 9 can be installed in new tanks or they can be retrofitted on existing tanks. Such retrofitting can be accomplished while the tank remains in service using the hot-tapping procedures, known to those with skill in the petroleum storage field. Thus, the inventive nozzles can be hot-tapped to existing tanks and connected to existing suction lines and the existing nozzle sealed off either partially or fully at the tank. A manifold or header (not shown) can be used to combine the multiple nozzles for connection to the existing suction line.

The above description relates to various preferred embodiments of the present invention, however, it will be apparent that many other modifications and variations can be effected by one skilled in the art without departing from the spirit and scope of the novel concepts of the present invention, wherein the scope of the invention may be determined only by the appended claims.

For example, in regard to the modifications to the oil delivery nozzles, as an alternative to providing repositioned nozzles of smaller cross section the same result may also be achieved by extending the existing suction nozzle inwardly and swaging it down, so as to similarly lower the level at which the suction takes place.

What is claimed is:

1. Apparatus for decreasing a quantity of oil held as deadstock in an oil storage tank having a top, bottom, and sides, an oil inlet pipe, and an oil delivery pipe located above the level of the bottom of the tank, the apparatus comprising:

positive volume displacement means for displacing a predetermined volume of oil including a tray having a solid, substantially flat bottom and upraised sides for retaining therein a quantity of material substantially inert to oil;

means for arranging said tray adjacent said bottom at a location determined by a lowermost edge and an uppermost edge of said oil delivery pipe; and means for preventing occlusion of said oil delivery pipe and for maintaining a quantity of oil at least above an uppermost edge of said oil delivery pipe.

2. Apparatus according to claim 1, in which said means for preventing occlusion include cutout means arranged in said upraised sides of said tray and having wall surfaces arranged substantially vertically, upper edges of said wall surfaces being higher than upper edges of said upraised sides.

3. Apparatus according to claim 2, in which said tray includes a substantially centrally arranged fluid overflow tube having an open upper end arranged below said upper edges of said wall surfaces and an open lower end in fluid communication with an external drain line.

4. Apparatus for decreasing the volume of oil held as undrawable in an oil storage tank of the kind having an oil inlet pipe, an oil delivery pipe, and a drain in the tank bottom for draining entrained water and sediment, comprising:

coffer dam means arranged adjacent and in front of said oil delivery pipe in sealing arrangement with a wall of said tank in proximately to said oil delivery pipe for defining a volume in front of said oil delivery pipe substantially less than the volume of said oil storage tank, said coffer dam means extending to a height above an uppermost edge of said oil delivery pipe; and liquid inlet means in fluid communication with the interior of said storage tank for causing liquid to flow therein to a level below an uppermost edge of said coffer dam means.

5. Apparatus according to claim 4, in which a second drain is provided arranged substantially at the bottom of said volume defined by said coffer dam means.

6. Apparatus according to claim 4, in which second coffer dam means are arranged adjacent and in front of said oil inlet pipe.

7. A method for decreasing a quantity of oil held as deadstock in an oil storage tank of the kind having top, bottom, and sides, an oil inlet pipe, and an oil delivery pipe located above the bottom of the tank, comprising the steps of:

providing a tray with a solid bottom and upraised sides inside the oil storage tank;

providing a volume displacement mass formed of a material that is inert relative to oil arranged in said tray;

arranging the tray adjacent the bottom for the tank;

shielding the oil delivery pipe to prevent the displacement mass from occluding the oil delivery pipe.

8. A method according to claim 7, including the step of providing a volume of water as the volume displacement mass.

9. A method according to claim 7, including the step of forming an overflow drain in the tray.

10. A method according to claim 7, including providing legs for supporting the tray on the tank bottom.

11. A method according to claim 7, in which the step of shielding includes the step of forming a coffer dam around the oil delivery pipe.

12. An improved oil suction line of the kind of use in an oil storage tank having top, bottom, and sides in which the oil suction line is of circular cross section and is located in a side above the bottom of the tank, the improvement comprising:

means for blocking off at least a portion of said oil suction line, said portion being an uppermost portion of said circular cross section;

additional oil suction line means formed as a pipe having a cross-sectional area subtantially equal to the area of the blocked off portion of said oil suction line; and means for arranging a lowermost edge of said additional oil suction line means at a height above said tank bottom determined by a lowermost edge of said oil suction line.

13. An improved oil suction line according to claim 12, in which said additional oil suction line means includes at least two pipes of circular cross section.

14. An improved oil suction line according to claim 12, in which the entire area of said circular cross section is blocked off and said additional oil suction line has an oblong cross section of height equal to the radius of said circular cross section and a length equal to pi times said radius.

15. An improved oil suction line according to claim 12, in which the entire area of said circular cross section is blocked off and said additional oil suction line has an oblong cross section of height equal to one-half the radius of said circular cross section and a length equal to two times said radius time pi.

16. Apparatus for decreasing a quantity of oil held as deadstock in an oil storage tank having a top, bottom, and sides, an oil inlet pipe, and an oil delivery pipe located above the level of the bottom of said tank, the apparatus comprising:

a plurality of substantially spherical positive volume displacement elements having a specific gravity greater than oil for displacing a predetermined volume of oil;

means for arranging said spherical elements adjacent said bottom at a location determined by a lowermost and uppermost edge of said oil delivery pipe; and means for preventing an occlusion of said oil delivery pipe and for maintaining a quantity of oil at least above an uppermost edge of said oil delivery pipe.

* * * * *

REEXAMINATION CERTIFICATE (808th)

United States Patent [19]

Almeida

[11] B1 4,537,211

[45] Certificate Issued Jan. 5, 1988

[54] APPARATUS FOR IMPROVING OIL STORAGE TANKS

[76] Inventor: Robert Almeida, 29 Overhill Rd., Scarsdale, N.Y. 10583

Reexamination Request:
No. 90/000,984, Apr. 14, 1986

Reexamination Certificate for:

| | |
|---|---|
| Patent No.: | **4,537,211** |
| Issued: | **Aug. 27, 1985** |
| Appl. No.: | **495,247** |
| Filed: | **May 17, 1983** |

[51] Int. Cl.[4] ..... F17D 1/00

[52] U.S. Cl. ..... 137/1; 137/172; 137/574; 210/534

[58] Field of Search ..... 137/1, 172, 574; 210/534

[56] References Cited

U.S. PATENT DOCUMENTS

| | | | |
|---|---|---|---|
| 1,113,683 | 10/1914 | Pfahler | 210/172 |
| 1,135,900 | 4/1915 | Hughson | 210/172 |
| 1,314,140 | 8/1919 | Jacobus | 210/153 |
| 1,406,950 | 2/1922 | Fackert | 210/800 |
| 1,530,077 | 3/1925 | Haynes | 210/533 |
| 1,548,400 | 8/1925 | Walker | 210/172 |
| 1,592,244 | 7/1926 | Wiggins | 210/219 |
| 1,714,338 | 5/1929 | Yelmgren | 210/534 |
| 1,768,209 | 6/1930 | Miller | 210/634 |
| 1,829,732 | 11/1931 | Allen | 210/172 |
| 2,422,869 | 6/1947 | Wiggins | 137/398 |
| 2,493,166 | 1/1950 | Schmitz, Jr. | 210/172 |
| 2,825,422 | 3/1958 | Schoenfeld | 210/187 |
| 3,964,873 | 6/1976 | Aromaki et al. | 138/DIG. 11 |
| 4,107,052 | 8/1978 | Yoshino et al. | 137/172 |
| 4,138,342 | 2/1979 | Middelbeek et al. | 210/522 |
| 4,170,877 | 10/1979 | Pickering | 137/574 |

FOREIGN PATENT DOCUMENTS

| | | | |
|---|---|---|---|
| 805512 | 5/1951 | Fed. Rep. of Germany | 138/DIG. 11 |

*Primary Examiner*—A. Michael Chambers

[57] ABSTRACT

A positive-displacement mass is introduced at the lowermost portion of an oil storage tank in order to reduce the amount of undrawable oil that remains at all times below the top edge of the suction line. It is necessary that the suction line not be occluded or interfered with and that the settled water at the bottom of the tank be permitted to be drawn off. In one aspect a tray is fitted into the bottom area of the tank and filled with water, or with inert solids, to displace the oil normally held as inventory at such location. In another aspect, a coffer dam is arranged around the suction line to permit the accumulation of water in the tank bottom, and in yet another aspect the shape and placement of the suction line nozzles are altered to improve storage efficiency.

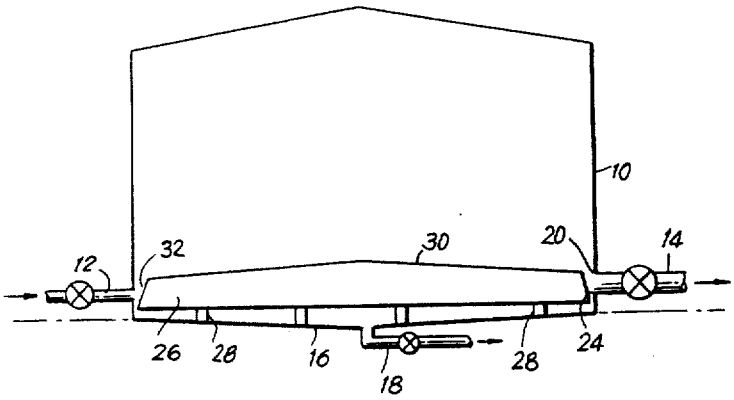

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5, 6 and 12–16 is confirmed.

Claim 4 is cancelled.

Claims 1 and 7 are determined to be patentable as amended.

Claims 2, 3 and 8–11, dependent on an amended claim, are determined to be patentable.

1. Apparatus for decreasing a quantity of oil held as deadstock in an oil storage tank having a top, bottom, and sides, an oil inlet pipe, and an oil delivery pipe located above the level of the bottom of the tank, the apparatus comprising:

positive volume displacement means *arranged inside said tank and being free of attachment to said tank top* for displacing a predetermined volume of oil including a tray having a solid, substantially flat bottom and upraised sides for retaining therein a quantity of material substantially inert to oil;

means for arranging said tray adjacent said bottom *and for affixing said tray thereto* at a location determined by a lowermost edge and an uppermost edge of said oil delivery pipe; and

*liquid impervious* means for preventing occlusion of said oil delivery pipe and for maintaining a quantity of oil at least above an uppermost edge of said oil delivery pipe *and being arranged in spaced-apart relationship with said oil delivery pipe.*

7. A method for decreasing a quantity of oil held as deadstock in an oil storage tank of the kind having top, bottom, and sides, an oil inlet pipe, and an oil delivery pipe located above the bottom of the tank, comprising the steps of:

providing a tray with a solid bottom and upraised sides inside the oil storage tank, *said tray having a volume substantially less than a volume of the oil storage tank and being free of attachment to the tank top;* providing a volume displacement mass formed of a material that is inert relative to oil arranged in said tray;

arranging the tray adjacent the bottom [for] *of* the tank;

shielding the oil delivery pipe to prevent the displacement mass from occluding the oil delivery pipe.

* * * * *